United States Patent [19]

Hoskinson

[11] 4,379,433

[45] Apr. 12, 1983

[54] INCINERATOR

[76] Inventor: Gordon H. Hoskinson, 186 Mayfair Rd., Floral Park, N.Y. 11001

[21] Appl. No.: 302,404

[22] Filed: Sep. 15, 1981

Related U.S. Application Data

[62] Division of Ser. No. 81,686, Oct. 4, 1979, Pat. No. 4,291,633.

[51] Int. Cl.[3] ..... F23B 5/00

[52] U.S. Cl. ..... 110/214; 110/235

[58] Field of Search ..... 110/210, 235, 214, 184, 110/212, 213; 126/312; 422/182; 431/5; 98/58

[56] References Cited

U.S. PATENT DOCUMENTS

| | | | |
|---|---|---|---|
| 3,567,399 | 3/1971 | Altmann et al. | 110/213 X |
| 3,599,581 | 8/1971 | Schoppe | 110/214 X |
| 3,844,233 | 10/1974 | Fishback | 110/212 X |
| 4,345,529 | 8/1982 | Weber et al. | 110/214 X |

FOREIGN PATENT DOCUMENTS

| | | | |
|---|---|---|---|
| 2225693 | 11/1974 | France | 110/212 |

*Primary Examiner*—Edward G. Favors

*Attorney, Agent, or Firm*—Andrus, Sceales, Starke & Sawall

[57] ABSTRACT

An incinerator having a generally cylindrical, horizontally disposed shell enclosed at its ends by vertical end plates and defining a combustion chamber. The upper sector of the shell is provided with a feed opening for introducing combustible waste into the housing and the opening extends continuously between the opposite end plates. Enclosing the feed opening is a generally curved door, the lower portion of which is hinged to the shell so that the door can be pivoted between a closed and open position. The gases of combustion are discharged from the combustion chamber through a stack and the upper portion of the shell bordering the stack can be formed with an enclosed heating jacket through which a heating medium can be circulated. Heat from the combustion of waste will act to heat the medium and the heated medium can be used for auxiliary heating purposes.

5 Claims, 9 Drawing Figures

Fig. 2
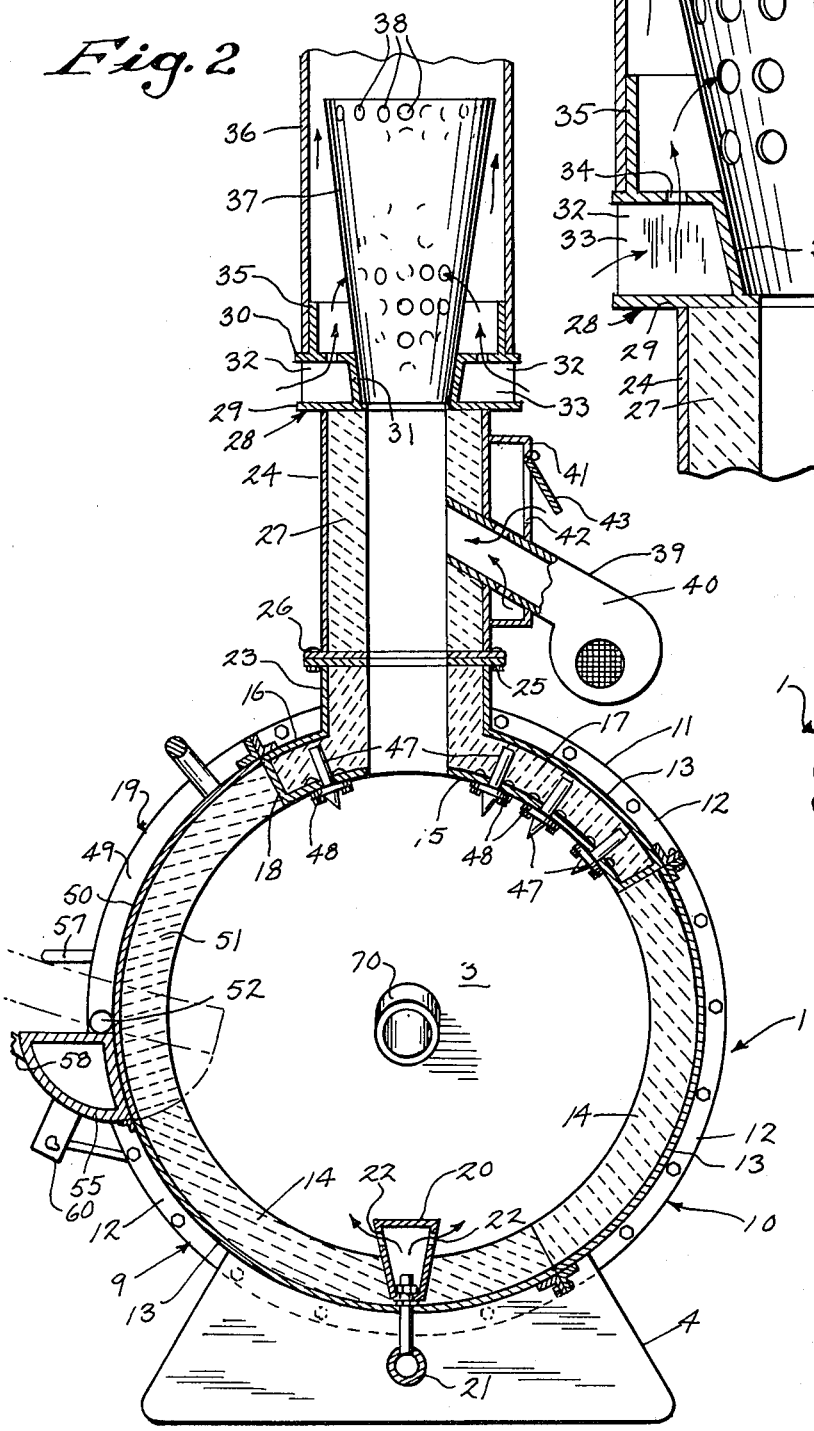
Fig. 3
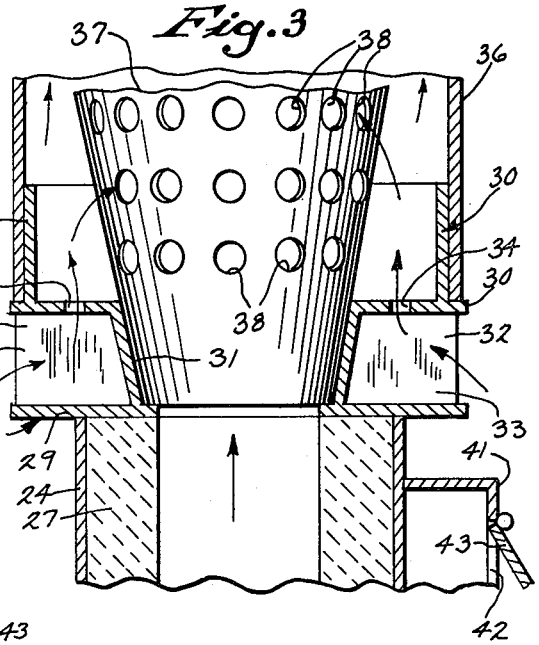
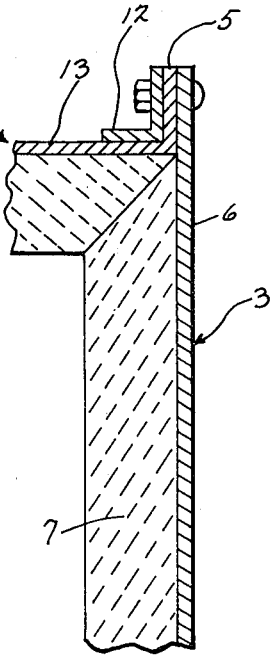
Fig. 4

INCINERATOR

This application is a division of application Ser. No. 6,081,686, now U.S. Pat. No. 4,291,633, filed Oct. 4, 1979.

BACKGROUND OF THE INVENTION

Incinerators of the type used in small commercial or industrial establishments, such as nursing homes, restaurants, food stores, and the like, often include a feeding mechanism which enables the waste material to be fed into a feed opening in the end wall of the incinerator. One common form of feeding mechanism includes a feed chute which is mounted on a movable cart. The cart is moved into position so that the end of the feed chute is aligned with the feed door in the incinerator, and the waste within the chute is then pushed along the chute and into the feed opening through use of a manual or automatic pusher mechanism.

The waste or litter to be burned is often contained in plastic bags. As the bags approach the incinerator on the feed chute, the heat will melt the plastic bags causing the waste to be distributed in the chute and making the feeding operation more difficult.

In a conventional starved air incinerator, a pocket of combustible gas often forms in the top of the combustion chamber. When the feed door is opened, oxygen enters the combustion chamber and the resulting combustion of the pocket of gas often results in flames being blasted out of the feed door to endanger the operator.

In most conventional installations, the incinerator has a relatively small feed opening with the result that larger items, such as wooden pallets, have to be broken up by the operator before they can be introduced into the combustion chamber.

SUMMARY OF THE INVENTION

The invention relates to an incinerator having particular use in small commercial or industrial establishments. The incinerator comprises a generally horizontal cylindrical shell or housing which defines a combustion chamber and the opposite ends of the shell are enclosed by vertical heads. The shell is preferably formed of pre-fabricated curved, modular sections, which are assembled together and connected to the heads at the site of use.

Located in the upper portion of the shell is a feed opening which extends the entire length of the shell between the opposite heads. The feed opening is enclosed by a curved door which is hinged at its lower edge to the shell and can be pivoted manually from a closed position to an open position. The feed opening has a substantial size, extending longitudinally between the heads and extending circumferentially through an arc of approximately 90°.

With the door in the open position, large objects can be fed into the combustion chamber and plastic bags containing waste can be thrown directly into the chamber without touching any heated components of the incinerator, thereby eliminating the possibility of the bags melting and the waste being discharged.

As the feed opening extends to approximately the top of the combustion chamber, opening of the door will immediately vent any pocket of combustible gas, thereby preventing a flashing of combustion, as can occur in a conventional type of incinerator.

The incinerator also includes a novel stack construction which improves the efficiency of combustion. The stack includes a lower stack section which is connected to the upper end of the combustion chamber, and an upper stack section which is spaced from the lower section to provide a series of air inlet openings. Located within the upper stack section is a diverging tapered sleeve having a series of perforations. A fuel burner is mounted in the lower stack section to aid in burning the waste combustion gases in a second zone of combustion. The gases pass upwardly from the lower stack section through the diverging sleeve to create an aspirating effect to draw additional air from the atmosphere in through the air inlet openings into the upper stack section, to thereby provide a final combustion zone to completely burn all of the combustible waste gases.

The upper portion of the cylindrical shell can be formed with an enclosed heating jacket in which water or other fluid is circulated and heated by the waste gases of combustion. The heated fluid can be then used for auxiliary heating purposes.

Other objects and advantages will appear in the course of the following description.

DESCRIPTION OF THE DRAWINGS

The drawings illustrate the best mode presently contemplated of carrying out the invention.

In the drawings:

FIG. 2 is a vertical section of the incinerator showing the door in the closed position;

FIG. 3 is an enlarged vertical section showing the attachment of the tapered sleeve to the mounting ring;

FIG. 4 is a sectional view showing the attachment of the shell and head;

DESCRIPTION OF THE PREFERRED EMBODIMENT

Figure 1:
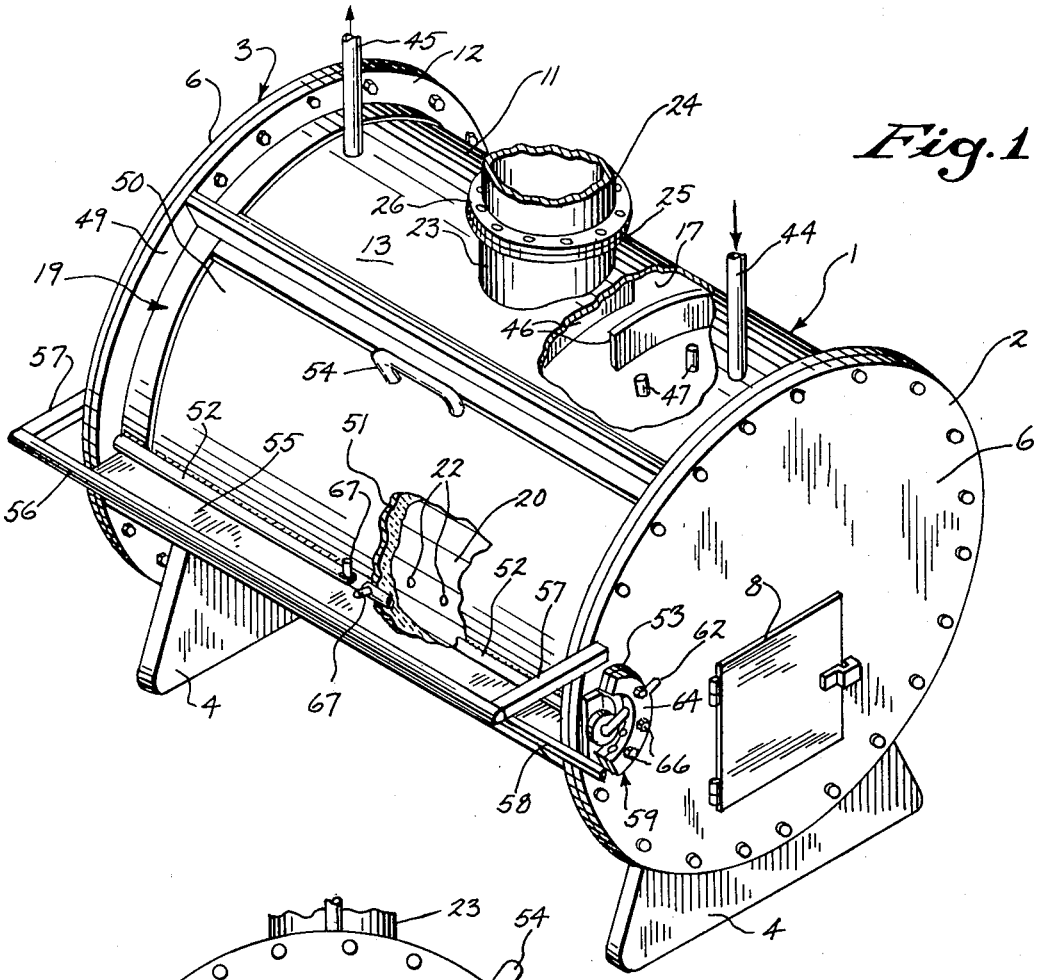
FIG. 1 is a perspective view of the incinerator of the invention with parts broken away.

The drawings illustrate an incinerator which is composed of a generally cylindrical, horizontally disposed shell 1, which defines a combustion chamber, and a pair of heads 2 and 3 enclose the opposite ends of the shell. The heads are provided with downwardly extending sections 4 which act as legs to support the incinerator from the supporting foundation.

Each of the heads 2 and 3 is composed of a generally circular ring 5 and a plate 6 is secured to the ring. Mounted on the inner surface of the plate 6 is a layer of refractory material 7 which is secured to plate 6 by a plurality of standard anchors, not shown.

The heads 2 and 3 have the same general construction, although the front head 2 is provided with an ash removal door 8 which is hinged to the head and can be opened to remove the ash and non-combustibles from the combustion chamber.

The cylindrical shell includes three generally curved sections 9, 10 and 11, each of which extends through an arc of approximately 90°. The shell sections 9 and 10 are fabricated in a manner similar to the heads 2 and 3 and each includes a peripheral angle member 12 and a curved plate 13, which is secured to the peripheral angle member. In addition, a layer of refractory material 14 is attached to the inner surface of the plate 13 by suitable anchors.

As illustrated, the upper shell section 11 defines a hollow heating jacket and includes the peripheral angle member 12 and plate 13 as well as an inner curved plate 15 which is connected to plate 13 by walls 16 to define a heating chamber 17.

Figure 5:
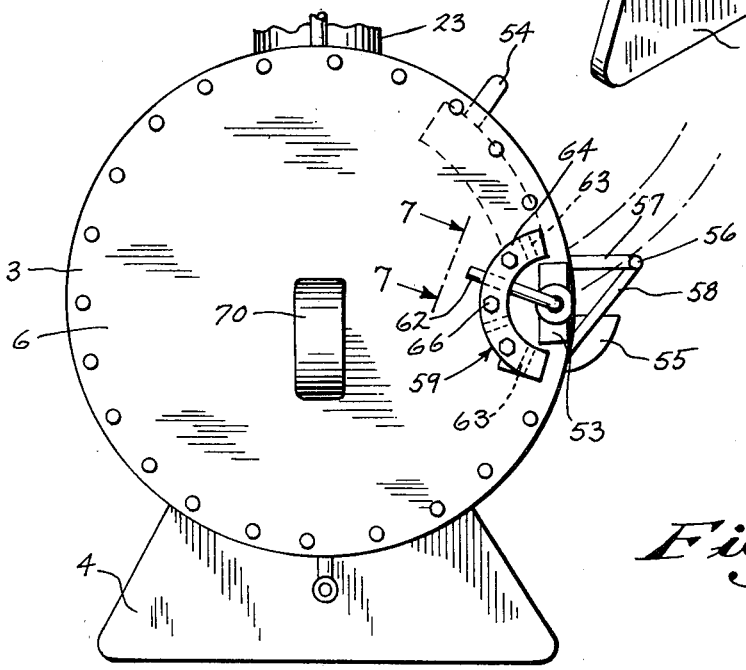
FIG. 5 is a rear end view of the incinerator.
Figure 6:
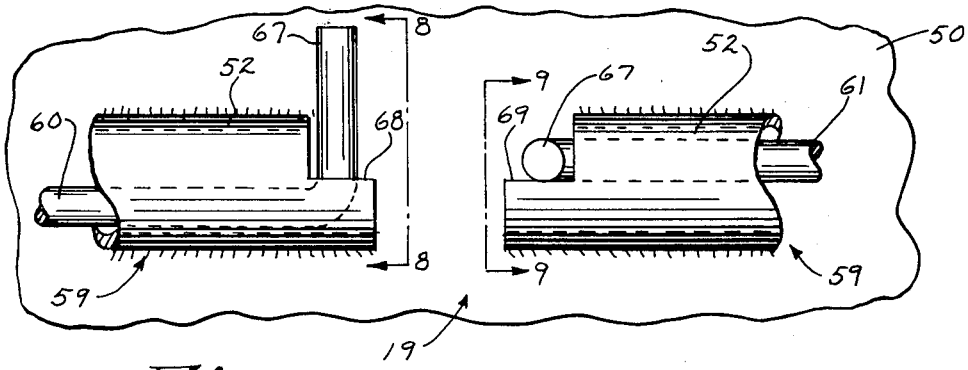
FIG. 6 is a fragmentary enlarged side elevation showing the torsion bar counterbalancing mechanism for the door.

As best illustrated in FIG. 2, the shell sections 9–11 are secured together by bolts which extend through the mating, outwardly extending flanges of the peripheral angle members 12. Similarly, the portions of the peripheral angle members 12 that are located along the ends of the sections 9–11 are bolted to the ring 5 of the respective heads 2 and 3, as illustrated in FIG. 5. This modular type of construction enables the shell to be assembled at the site of use, rather than at the factory, thereby greatly simplifying the shipping and handling of the unit.

The upper portion of the shell defines a feed opening 18 which is enclosed by a hinged door 19.

To supply air to the combustion chamber, an air inlet tube 20 is mounted on the inner surface of the shell section 9 and extends substantially the full length of the shell. As shown in FIG. 2, the air inlet tube 20 has a generally frustoconical shape in cross section and is partially embedded within the refractory layer 14. Air is supplied to the tube 20 through a manifold 21, which is connected to a blower or other source of air under pressure, and the air is discharged along the length of the tube 20 through a plurality of outlet ports 22.

The waste gases of combustion are discharged from the combustion chamber through an outlet 23 formed in the upper shell section 11, and the outlet 23 is connected to a lower stack 24. The outlet 23 and lower stack 24 have mating flanges 25 and 26 which are bolted together, and the inner surface of the lower stack 24 is provided with a refractory lining 27.

Mounted across the top of the lower stack 24 is an upper expansion ring 28 formed of a base plate 29 and a parallel upper plate 30 which is spaced from the base plate by a central upwardly diverging ring 31 and a series of vertical spacers 32 that extend radially outward from the central ring 31. The spaces between the spacers 32 define air inlet passages 33. The upper plate 30 is provided with a plurality of openings 34 which communicate with the air inlet passages 33.

Extending upwardly from the base plate 29 is an annular flange 35. As shown in FIG. 3, the lower end of an upper stack 36 rests on the upper plate 29 and is secured to the outer flange 35. A tapered sleeve 37, which diverges upwardly is mounted on the inner portion of the base plate 29, inwardly of the diverging ring 31 and the ring 31 is tapered to complement the taper of the sleeve 37. As shown in FIGS. 2 and 4, sleeve 37 is formed with a plurality of ports or perforations 38.

A gas burner assembly 39 is mounted in the lower stack 24 and includes a conventional gas burner 40 which is secured within a housing 41 attached to the outer surface of the lower stack. The housing 41 is provided with an air inlet opening 42 enclosed by an adjustable cover 43. Adjustment of the position of the cover 43 will regulate the amount of air introduced into housing 41 through the opening 42.

The waste gases of combustion resulting from the burning of the waste in the combustion chamber pass upwardly through the lower stack 24 and the combustible portion of the waste gases is burned by the burner 40. The gas then passes upwardly through the tapered sleeve 37 and the high velocity gas produces an aspirating effect which draws air from the atmosphere through the inlet passages 33 and through the openings 34 into the upper stack 36. A portion of the entering air will pass inwardly through the perforations 38 into the interior of the sleeve 37, while a second portion of the air will pass around the sleeve and merge with the waste gases at the upper end of the sleeve. The additional air introduced into the upper stack from the atmosphere will result in a final zone of combustion to completely burn any combustible material remaining in the exhaust gases.

During operation, sleeve 37 will be exposed to extremely high temperatures, and as the sleeve is freely mounted within the ring 31, the sleeve, on expansion due to heating, can "walk" upwardly within the tapered ring, thereby preventing undue stress on the sleeve at high temperature operation.

To provide auxiliary heating, the upper shell section 11, as previously noted, defines a heating chamber 17 and a heating medium, such as water or air, is circulated through the chamber. A medium to be heated is introduced into the heating chamber 27 through an inlet conduit 44 and is discharged from the chamber through a conduit 45. As shown in FIG. 1, the heating chamber 17 includes a series of baffles 46 which provide a tortuous path of travel for the medium and thereby increases the rate of heat transfer.

To further increase the rate of heat transfer from the waste gases of combustion in the combustion chamber to the medium in the heating chamber 17, a series of heat plugs 47 are utilized. As shown in FIG. 2, each heat plug 47 is provided with a flange 48 which is mounted on the inner plate 15 of shell section 11. The inner ends of the heat plugs 47 project into the combustion chamber, while the outer ends of the plugs extend into the heating chamber 17. The plugs 47 aid in transferring heat between the waste gases of combustion in the combustion chamber and the medium, such as water, flowing within the heating chamber 17.

The door 19 which enclosed the feed opening 18 has a construction similar to that of the shell sections 9 and 10 and includes a peripheral angle member 49 and an outer plate 50 which is secured to the flange of the angle member. A layer of refractory material 51 is attached to the inner surface of the plate 50 by suitable anchors.

The curved door 19 has a length equal to the distance between heads 2 and 3 and extends approximately 90° in a circumferential direction.

To pivot the door 19 relative to the shell 1, a pair of hollow shafts 52 are secured to the lower portion of the door and are journalled within trunions 53 secured to the heads 2 and 3, respectively. To aid in moving the door between the open and closed positions, a handle 54 is secured to the upper portion of the door.

A curved shield 55 is mounted on the lower portion of the door and projects outwardly of the door. The shield 55 extends the complete length of the door and rides along the upper edge of the shell section 9 when the door is moved to the open position. When the door is open, the shield will provide a closure between the lower edge of the door and the upper edge of section 9 to prevent the propogation of flames outwardly from the combustion chamber.

The open position of the door is limited by a stop rod 56 which is mounted on brackets 57 and 58 secured to each head 2 and 3.

Figure 7:
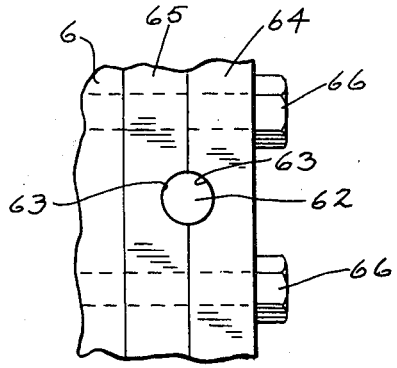
FIG. 7 is a view taken along line 7—7 of FIG. 5.

To aid in moving the door 19 between the open and closed positions, a pair of torsion bar counterbalancing assemblies 59 are associated with the door. Each counterbalancing assembly includes a torsion bar or rod 60 and 61 which is disposed within the respective hollow shaft 52. As shown in FIG. 7, the outer end 62 of each torsion bar is bent radially and is locked within one of a series of mating notches or grooves 63 in curved plates 64 and 65 which are secured to the respective heads 2 and 3 by bolts 66. The several mating grooves 63, which extend radially of the axis of the torsion rod, provide a measure of adjustment for the force of the torsion rod.

Figure 8:
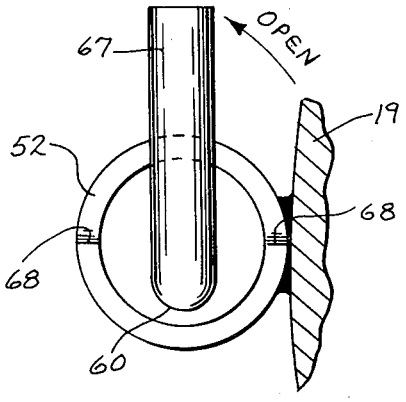
FIG. 8 is a section taken along line 8—8 of FIG. 6.
Figure 9:
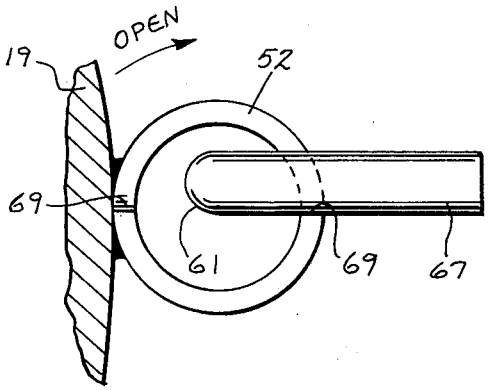
FIG. 9 is a section taken along line 9—9 of FIG. 6.

The inner ends 67 of torsion bars 60 and 61 are also bent radially and extend outwardly through notches 68 and 69, respectively, located in the ends of the shafts 52. When the door is in a partially open position, in which the center of gravity is in general vertical alignment with the pivot shafts 52, the bent ends 67 of torsion rods 60 and 61 are out of contact with the edges bordering the respective notches 68 and 69. In this position, there will be no counterbalancing torsion force acting on the door. When the door is moved to a closed position, the edge of the notch 69 in shaft 52 will engage the end 67 of the torsion bar 61, to rotate the bar and place the bar under torsion and thereby exert a counterbalancing force to urge the door to the open position. The gravity moment of the door in the closed position will be greater than the counterbalancing force, so that the door will be held in the closed position. In the closed position, the edge of notch 68 will be out of contact with the end 67 of torsion bar 60, as shown in FIG. 8.

When the door is moved toward the full open position, the edge bordering notch 68 will engage the inner end 67 of torsion bar 60 to rotate the torsion bar and place the bar under torsion to exert a counterbalancing force. When the door is in the full open position, edge 69 will be out of contact with bent end 67 of torsion rod 61, so the torsion bar 61 will be in an inoperative condition.

The waste or trash deposited in the combustion chamber can be ignited manually, or alternately, the incinerator can include a fuel burning means, such as a gas burner, indicated by 70, which can be used to ignite the waste for start-up.

As the door 19 extends to substantially the top of the combustion chamber, any pocket of combustible waste gas in the upper portion of the chamber will be immediately vented when the door is opened so that there will be no flash back of combustion to endanger the operator.

As the door has substantial size, large items such as pallets, can be introduced into the combustion chamber without the necessity of breaking the pallets into smaller-sized pieces. Furthermore, plastic bags containing waste can be deposited directly in the combustion chamber without contacting a heated chute or other heated components of the incinerator. Thus, the plastic bags will not melt and the waste will be retained in the bags until it is safely deposited in the combustion chamber.

The shell is of modular construction and can be readily assembled in the field without the need of a crane or other hoisting equipment. This greatly simplifies the shipping and assembly requirements of the incinerator.

The use of the heating chamber 17 enables the incinerator to generate heat for auxiliary uses which reduces the overall energy requirements for the particular establishment.

Various modes of carrying out the invention are contemplated as being within the scope of the following claims particularly pointing out and distinctly claiming the subject matter which is regarded as the invention.

I claim:

1. As incinerator, comprising a housing defining a combustion chamber, a stack connected to the combustion chamber for discharging waste gases of combustion, said stack including a lower stack section and an upper stack section spaced above the lower section, a ring structure disposed between the lower end of the upper stack section and the upper end of the lower stack section and having a central opening, said ring structure including a tapered flange bordering said central opening, said flange diverging in an upward direction, an upwardly diverging sleeve freely supported on the ring structure and disposed concentrically of said tapered flange, said sleeve having a plurality of perforations, and air inlet means associated with said ring structure for providing communication between the atmosphere and the upper stack section, waste gases of combustion passing upwardly from said lower stack section through said sleeve causing an aspirating effect to draw air from the atmosphere through said air inlet means and into said upper stack section and into said perforations to effect a final combustion zone for the waste gases of combustion, expansion of said sleeve due to heating causing the sleeve to move upwardly relative to said flange.

2. The incinerator of claim 1, wherein said ring structure includes an upper ring and a lower ring spaced beneath said upper ring, said flange connecting said rings.

3. The incinerator of claim 2, wherein said upper ring is provided with a plurality of openings disposed outwardly of said flange, the space between said rings in combination with said openings defining said air inlet means.

4. The incinerator of claim 2, wherein said upper stack section is supported on said upper ring.

5. The incinerator of claim 3, and including fuel burning means located within the lower stack section for burning the combustible portion of the waste gases in a secondary zone of combustion, and adjustable air inlet means for supply air to said fuel burning means.

* * * * *